US006463244B2

(12) United States Patent
Aoki et al.

(10) Patent No.: US 6,463,244 B2
(45) Date of Patent: Oct. 8, 2002

(54) IMAGE FORMING APPARATUS, DEVELOPING DEVICE THEREFOR AND IMAGE FORMING PROCESS UNIT

(75) Inventors: Katsuhiro Aoki, Kanagawa; Hajime Oyama, Chiba; Takashi Hodoshima, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/814,726

(22) Filed: Mar. 23, 2001

(65) Prior Publication Data

US 2001/0038763 A1 Nov. 8, 2001

(30) Foreign Application Priority Data

Mar. 24, 2000 (JP) ..... 2000-085391

(51) Int. Cl.[7] ..... G03G 15/08
(52) U.S. Cl. ..... 399/267; 399/270; 399/272
(58) Field of Search ..... 399/267, 270, 399/272, 276, 277, 282

(56) References Cited

U.S. PATENT DOCUMENTS

| | | | |
|---|---|---|---|
| 5,109,254 A | | 4/1992 | Oka et al. |
| 5,339,141 A | | 8/1994 | Suzuki et al. |
| 5,341,196 A | | 8/1994 | Hodoshima et al. |
| 5,416,568 A | | 5/1995 | Yoshiki et al. |
| 5,424,814 A | | 6/1995 | Suzuki et al. |
| 5,450,177 A | | 9/1995 | Oyama |
| 5,565,973 A | | 10/1996 | Fujishiro et al. |
| 5,598,254 A | | 1/1997 | Ikesue et al. |
| 5,655,193 A | | 8/1997 | Fujishiro et al. |
| 5,659,860 A | | 8/1997 | Sasaki et al. |
| 5,771,426 A | | 6/1998 | Oka et al. |
| 5,774,772 A | | 6/1998 | Kai et al. |
| 5,805,965 A | | 9/1998 | Tsuda et al. |
| 5,822,664 A | | 10/1998 | Oka et al. |
| 5,864,733 A | | 1/1999 | Mae et al. |
| 5,915,155 A | | 6/1999 | Shoji et al. |
| 5,953,570 A | * | 9/1999 | Hirai ..... 399/282 |
| 6,081,684 A | | 6/2000 | Naganuma et al. |
| 6,125,243 A | | 9/2000 | Shoji et al. |
| 6,160,979 A | | 12/2000 | Shoji |
| 6,163,669 A | | 12/2000 | Aoki et al. |

OTHER PUBLICATIONS

U.S. patent application Ser. No. 09/944,076, filed Sep. 4, 2001, pending.
U.S. patent application Ser. No. 09/945,839, filed Sep. 5, 2001, pending.
U.S. patent application Ser. No. 09/948,576, filed Sep. 10, 2001, pending.
U.S. patent application Ser. No. 10/050,955, filed Jan. 22, 2002, pending.
U.S. patent application Ser. No. 09/662,550, filed Sep. 15, 2000, pending.
U.S. patent application Ser. No. 09/708,659, filed Nov. 2000, pending.
U.S. patent application Ser. No. 09/814,726, filed Mar. 23, 2001, pending.
U.S. patent application Ser. No. 09/964,794, filed Sep. 28, 2001, pending.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A developing device for an image forming apparatus includes a developing roller for conveying toner deposited thereon to a developing region where it faces a photoconductive element. A magnet brush roller conveys a two-ingredient type developer, which consists of toner and magnetic particles, deposited thereto to a toner supplying region where it faces the developing roller. In the toner supplying region, only the toner is supplied from the magnet brush roller to the developing roller. The distribution of the number of toner particles for an amount of charge differs from the developing roller to the magnet brush roller.

23 Claims, 15 Drawing Sheets

| | VALUE | UNIT |
|---|---|---|
| WEIGHT | 71.7 | $g/m^2$ |
| THICKNESS | 89 | $\mu m$ |
| DENSITY | 0.81 | $g/cm^3$ |
| SMOOTHNESS (FRONT) | 40 | s |
| SMOOTHNESS (REAR) | 37 | s |
| VOLUME RESISTIVITY | $1.2 \times 10^{11}$ | $\Omega$ cm |

FIG. 20

| SURFACE TREATMENT<br>MAX. COEFFICIENT OF FRICTION μ | NO TREATMENT<br>μ=0.57~0.59 | | ZINC STEARATE<br>μ=0.22~0.25 | | SILICONE OIL<br>μ=0.2 |
|---|---|---|---|---|---|
| DEVELOPING ROLLER | | | | | |
| HARDNESS (JIS-A) / CONTACT PRESSURE | 40° | 20° | 40° | 20° | 40° |
| 24N/m(=3g/mm) | 0.035 | 0.032 | 0.006 | 0.004 | 0.009 |
| 39N/m(=4g/mm) | 0.033 | 0.034 | 0.008 | 0.000 | 0.165 |
| 59N/m(=6g/mm) | | | 0.005 | 0.005 | 0.021 |
| 78N/m(=8g/mm) | 0.021 | 0.025 | 0.008(B) | 0.005 | 0.013 |
| 98N/m(=10g/mm) | | | | 0.005 | |
| 118N/m(=12g/mm) | 0.024(A) | 0.026(A) | 0.005(C) | 0.000 | 0.007 |
| 137N/m(=14g/mm) | | | 0.009(C) | 0.000(B) | 0.146(C) |
| 157N/m(=16g/mm) | | | (C) | 0.000(C) | 0.054(C) |
| 176N/m(=18g/mm) | | | (C) | 0.000(C) | |

FIG. 21

| | CHARGE OF TONER SUPPLIED 1 [μC/g] | CHARGE OF TONER TOPHING LAYER 2 [μC/g] | RATIO OF 1 TO 2 [%] | IMAGE CHARACTERISTIC (BACKGROUND CONTAMINATION RANK) |
|---|---|---|---|---|
| EMBODIMENT | −15±2 | −12±2 | 125 | 5 |
| PRIOR ART | −3±2 | −12±2 | 25 | 3 |

FIG. 22

| | SURFACE LAYER OF DEVELOPING ROLLER | TONER SUPPLY POTENTIAL $\Delta V_{sup}$ |
|---|---|---|
| EXPERIMENT OF FIG. 13 | SILICONE RUBBER | 100V |
| EXPERIMENT OF FIG. 14 | SILICONE RUBBER | 20V |
| EXPERIMENT OF FIG. 15 | URETHANE RESIN | 100V |

IMAGE FORMING APPARATUS, DEVELOPING DEVICE THEREFOR AND IMAGE FORMING PROCESS UNIT

BACKGROUND OF THE INVENTION

1. Field of the Invention

The present invention relates to a copier, printer, facsimile apparatus or similar image forming apparatus. More particularly, the present invention relates to a developing device of the type including a toner carrier for conveying toner deposited thereon to a developing region where it faces an image carrier, and a toner supply member for conveying a two-ingredient type developer, which consists of the toner and magnetic particles, to a toner supplying region where it faces the toner carrier and feeds only the toner to the toner carrier, an image forming apparatus including the same, and an image forming process unit.

2. Discussion of the Background

Generally, a developing device for an image forming apparatus uses either one of a single-ingredient type developer, i.e., toner and a two-ingredient type toner that is a mixture of toner and magnetic carriers. In any case, the developing device develops a latent image formed on an image carrier with the toner. The developing device using a single-ingredient type toner is simple in construction and small size. Further, this type of developing device, which does not use magnetic particles, is free from so-called magnet brush marks particular to the developing device using a two-ingredient type developer. The magnet brush marks refer to an occurrence that a latent image is not faithfully developed due to the influence of a magnet brush, which is formed by the developer, contacting the image carrier. In addition, the developing device using a single-ingredient type developer forms a thinner developer later than the developing device using a two-ingredient type developer and suffers from a minimum of edge effect. For these reasons, this type of developing device can desirably reproduce high-definition images. Particularly, the developing device using only nonmagnetic toner is highly adaptive to color printing and can produce high-definition color images.

The developing device using a single-ingredient type developer charges the toner deposited on the toner carrier by friction with a blade, toner supply roller or similar contact member contacting the toner carrier. With this charging scheme, however, it is difficult to promote rapid control over the charge of toner and the enhancement of durability. Further, the contact member, pressing the toner on the toner carrier, brings about stress in the toner and therefore toner filming. In addition, the contact member is likely to cause an agent covering the individual toner particle to penetrate into the particle, degrading image quality. Moreover, the toner carrier and contact member wear due to friction acting therebetween and vary the developing characteristic due to aging. To solve such problems, it is preferable to supply toner charged to preselected polarity to the toner carrier without using the blade, toner supply roller or similar contact member.

In light of the above, Japanese Patent Laid-Open Publication Nos. 56-40862 and 59-172662, for example, each disclose a developing device including a toner supply member on which a two-ingredient type developer forms a magnet brush. In this type of developing device, only toner is fed from the magnet brush to a toner carrier. The toner supply member is implemented by a magnet roller or a magnet brush forming body. Toner in the magnet brush is charged to preselected polarity by friction acting between it and magnetic particles. Only the toner particles charged to the preselected polarity is separated from the magnet brush and transferred to the toner carrier, which is a developing roller or a toner layer support.

However, the problem with the developing device of the type transferring only toner from the magnet brush formed on the toner supply member is that when it develops a latent image formed on the image carrier, background contamination and short image density occur and degrade image quality. We experimentally found that the amount of charge deposited on the toner on the toner carrier was not distributed in an expected manner, resulting in background contamination and short image density. For example, when the number of toner particles charged to polarity opposite to expected polarity increases, they contaminate the background. Also, when the number of excessively charged toner particles increases, toner particles available for development decreases, resulting in short image density.

An arrangement may be made such that the charge distribution of toner on the toner carrier and the charge distribution on the toner supply member are the same with each other. However, the charge distribution of toner on the toner supply member is apt to differ from expected one due to the frictional charging characteristic required of the magnet brush formed on the toner supply member. In such a case, the charge distribution on the toner carrier, which received toner from the toner supply member, is also deviated from expected one.

The developing device of the type transferring only toner from the magnet brush on the toner supply member to the toner carrier may be used to develop a latent image formed on the image carrier by a so-called bilevel process. Today, a bilevel process is extensively used as an image forming process dealing with digital image data. Specifically, the bilevel process controls the individual pixel on the basis of whether or not a dot of preselected density and preselected size exists. The bilevel process renders tonality in terms of the density of, among pixels forming an image, pixels on which toner is to deposit for a unit area.

However, when the developing device of the type described develops a latent image formed on the image carrier by the bilevel process, background contamination and short image density also occur, depending on various conditions. For example, assume that the surface potential of the image carrier or the amount of charge or similar developing characteristic of the developer varies due to the varying environment or aging. Then, unnecessary toner deposits around dots, i.e., pixels on which toner is expected to deposit, contaminating the background or making the density of the dots short.

SUMMARY OF THE INVENTION

It is therefore an object of the present invention to provide a developing device capable of forming a high-quality toner image free from background contamination and short density without resorting to a contact member that charges toner on a toner carrier by friction, an image forming apparatus including the same, and an image forming process unit.

In accordance with the present invention, a developing device includes a toner carrier for carrying toner on its surface and conveying it to a developing region where the toner carrier faces an image carrier. A toner supply member carries thereon a two-ingredient type developer, which consists of the toner and magnetic particles, and conveys it to a toner supplying region where the toner supply member faces the toner carrier. Only the toner is fed from the toner supply member to the toner carrier in the toner supplying region. A number distribution, which is the distribution of the number of toner particles for an amount of charge deposited on the toner particles, differs from the toner particles conveyed to the developing region by the toner carrier to the toner particles contained in the developer that is deposited on the toner supply member.

Also, in accordance with the present invention, in an image forming apparatus including an image carrier, a latent image forming device for forming a latent image on the image carrier, a developing device for developing the latent image to thereby produce a corresponding toner image, and an image transferring device for transferring the toner image to a recording medium, the developing device includes a toner carrier for carrying toner on its surface and conveying it to a developing region where the toner carrier faces an image carrier. A toner supply member carries thereon a two-ingredient type developer, which consists of the toner and magnetic particles, and conveys it to a toner supplying region where the toner supply member faces the toner carrier. Only the toner is fed from the toner supply member to the toner carrier in the toner supplying region. A number distribution, which is the distribution of the number of toner particles for an amount of charge deposited on the toner particles, differs from the toner particles conveyed to the developing region by the toner carrier to the toner particles contained in the developer that is deposited on the toner supply member.

Further, in accordance with the present invention, in an image forming process unit including an image carrier, a charger for uniformly charging the surface of the image carrier, a developing device for developing the latent image to thereby produce a corresponding toner image, and a cleaning device for cleaning the surface of the image carrier that are constructed into a unit removable from an image forming apparatus, the developing device includes a toner carrier for carrying toner on its surface and conveying it to a developing region where the toner carrier faces an image carrier. A toner supply member carries thereon a two-ingredient type developer, which consists of the toner and magnetic particles, and conveys it to a toner supplying region where the toner supply member faces the toner carrier. Only the toner is fed from the toner supply member to the toner carrier in the toner supplying region. A number distribution, which is the distribution of the number of toner particles for an amount of charge deposited on the toner particles, differs from the toner particles conveyed to the developing region by the toner carrier to the toner particles contained in the developer that is deposited on the toner supply member.

BRIEF DESCRIPTION OF THE DRAWINGS

The above and other objects, features and advantages of the present invention will become more apparent from the following detailed description taken with the accompanying drawings in which:

FIG. 20 is a table listing the results of experiments conducted to determine a relation between the contact pressure of the developing roller and the developing characteristic with respect to three different cases;

FIG. 21 is a table listing the results of experiments conducted to determine a relation between the amount of charge deposited on toner and the image characteristic with the illustrative embodiment and a conventional developing device; and FIG. 22 is a table listing materials applied to the developing roller and toner supply potentials used for the experiments of FIGS. 13 through 15.

DESCRIPTION OF THE PREFERRED EMBODIMENT

Figure 1:
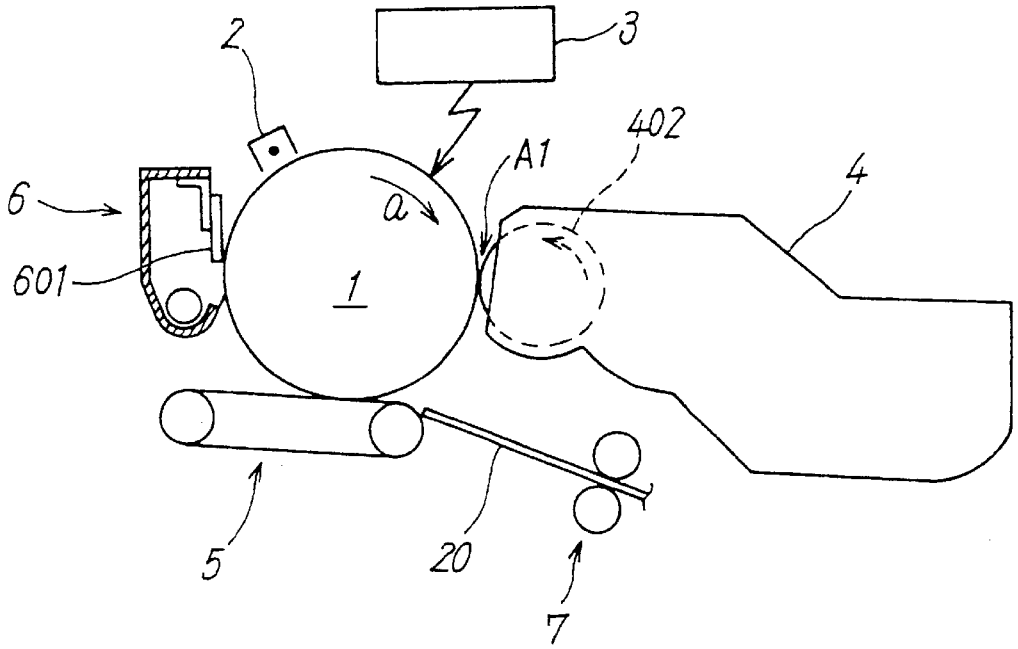
FIG. 1 is a view showing an image forming apparatus embodiment the present invention and implemented as a printer by way of example.

Referring to FIG. 1 of the drawings, an image forming apparatus embodying the present invention is shown and implemented as an electrophotographic laser printer by way of example. As shown, the printer includes a photoconductive drum 1, which is a specific form of an image carrier. A charger 2, an exposing device 3, a developing device 4, an image transferring device 5 and a cleaning device 6 are sequentially arranged around the drum 1. The charger 2 uniformly charges the surface of the drum 1. The exposing device 3 scans the charged surface of the drum 1 with, e.g., a laser beam in accordance with image data. The developing device 4 includes a developing roller 402 and develops the latent image with toner via the developing roller 402 to thereby produce a corresponding toner image. The image transferring device 5 transfers the toner image from the drum 1 to a paper sheet or similar recording medium 20. The cleaning device 6 removes the toner left on the drum 1 after the image transfer.

A paper feeder, not shown, feeds a paper sheet from a tray not shown. Also, a fixing device, not shown, fixes the toner image transferred from the drum 1 to the paper sheet 20.

Figure 2:
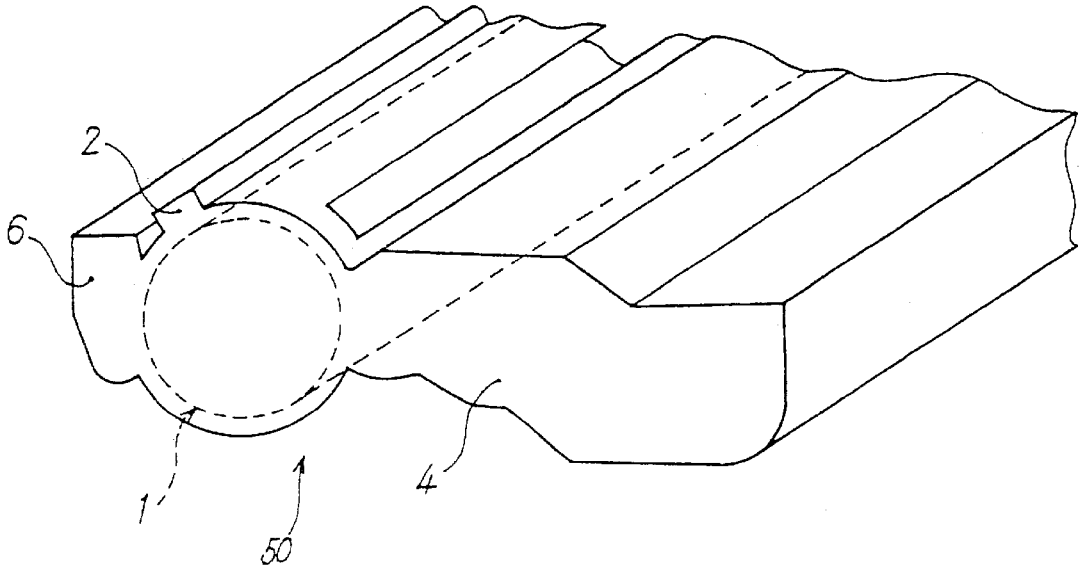
FIG. 2 is a fragmentary isometric view of a process unit applicable to the printer of FIG. 1.

Part of the devices constituting the printer may be constructed into a unit removable from the printer body, if desired. For example, as shown in FIG. 2, the drum 1, charger 2, developing device 4 and cleaning device 6 may be constructed into a single image forming process unit 50.

In operation, while the drum 1 is rotated in a direction a shown in FIG. 1, the charger 2 uniformly charges the surface of the drum 1. The exposing device 3 scans the charged surface of the drum 1 with a laser beam in the axial direction of the drum 1 in accordance with image data, thereby forming a latent image on the drum 1. The developing device 4 deposits charged toner on the latent image in a developing region A1 to thereby produce a corresponding toner image. The paper sheet 20 is fed from the paper feeder to a registration roller pair 7. The registration roller pair 7 once stops the paper sheet 20 and then conveys it at a preselected timing to an image transfer position where the drum 1 and image transferring device 5 face each other. The image transferring device 5 charges the paper sheet 20 to polarity opposite to the polarity of the toner and thereby transfers the toner image from the drum 1 to the paper sheet 20. The paper sheet 20 is then separated from the drum 1 and conveyed to the fixing device not shown. The fixing device fixes the toner image on the paper sheet. After the image transfer, the cleaning device 6 removes the toner left on the drum 1.

The configuration of the drum 1 will be described specifically hereinafter. The drum 1 is made up of a hollow cylindrical core formed of, e.g., aluminum and a photoconductive layer formed on the core by coating the core with an organic or an inorganic photoconductor. Alternatively, use may be made of a photoconductive belt made up of a relatively thin base formed of polyethylene terephthalate (PET), polyethylene naphthalate (PEN) or nickel and a photoconductive layer formed on the base. While the drum 1 is uniformly chargeable to negative polarity in the illustrative embodiment, it may be chargeable to positive polarity in consideration of, e.g., the polarity to which the toner is charged. In the illustrative embodiment, the drum 1 has a diameter of 50 mm and rotates at a linear velocity of 200 mm/sec.

Further, in the illustrative embodiment, the drum 1 has a surface whose coefficient of friction lies in a preselected range. Specifically, the maximum static coefficient of friction $\mu$ of the surface is greater than or equal to 0.1, but smaller than or equal to 0.4. The maximum coefficient of friction lying in the above range successfully prevents needless toner from depositing on the drum 1 in the developing region A1. In addition, such a coefficient of friction reduces friction between the drum 1 and a cleaning blade 601 (see FIG. 1) and thereby extends the life of the drum 1.

In the illustrative embodiment, a lubricant is applied to the surface of the drum 1 at a preselected timing in order to confine the maximum static coefficient of friction in the above-mentioned range. For the application of the lubricant, any one of conventional schemes may be used. Japanese Patent Laid-Open Publication No. 4-372981, for example, teaches that when use is made of toner whose volumetric mean grain size is 4 m to 10 m, a substance that reduces the coefficient of friction of a photoconductive element is fed to the element. The above document also teaches that a lubricant may be directly applied or a member carrying a lubricant may contact the photoconductive element either constantly or periodically. By so applying a lubricant to the surface of the drum 1, it is possible to confine the maximum static coefficient of friction $\mu$ in the range of from 0.1 to 0.4. If desired, the photoconductor forming the surface of the drum 1 may contain a lubricant beforehand.

Figure 3:
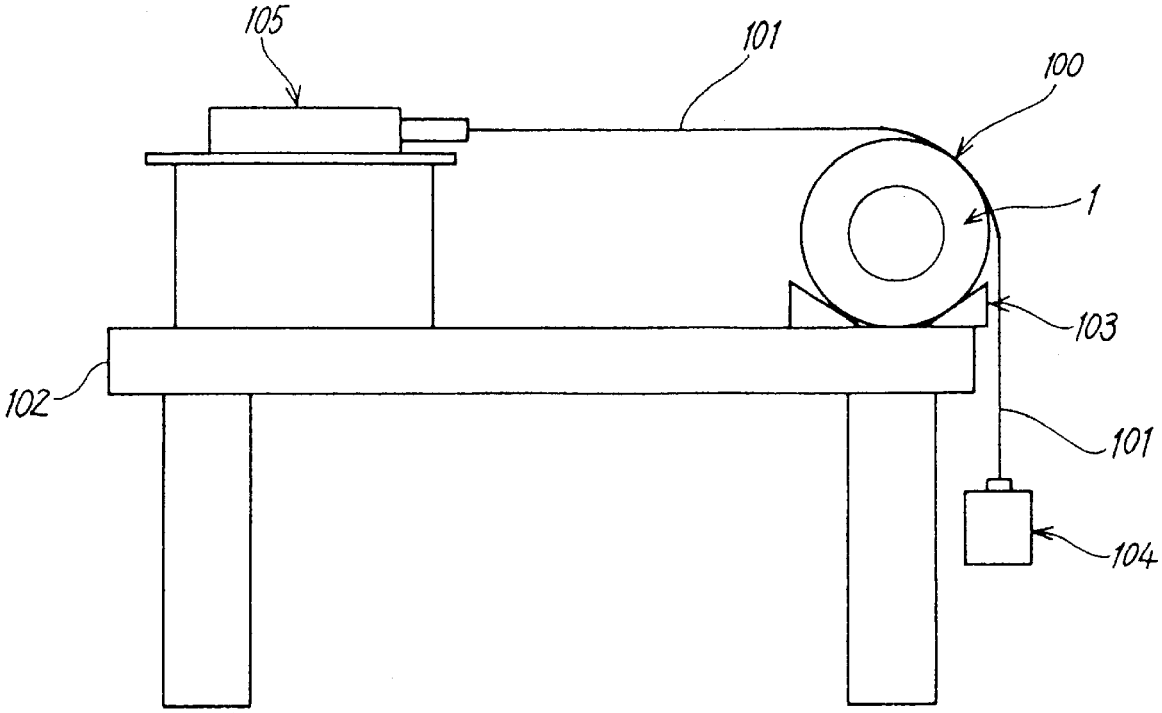
FIG. 3 is a view showing a specific arrangement for measuring the maximum static coefficient of friction of the surface of a photoconductive element.

FIG. 3 shows a specific arrangement used to measure the maximum static coefficient friction of the drum 1. As shown, a sheet TYPE 6200 (size A4) available from Ricoh Co., Ltd. is cut to prepare a sample sheet 100 sized 297 mm×30 mm. Threads 101 are anchored to opposite edges of the sheet 100. The sample sheet 100 has property listed in FIG. 19.

The drum 1 is set on a support member 103 mounted on a table 102. The sample piece 100 is laid on the drum 1 with its rear side contacting the drum 1. A weight 104, which is 0.98 N (=100 g) heavy, is attached to one thread 101. The other thread 101 is anchored to a digital force gauge (digital push-pull gauge) 105. In this condition, the weight 104 pulls the sample sheet 100. The gauge 105 is read when the sample sheet 100 starts moving. Assuming that the read value of the gauge 105 is F (N), then the maximum static coefficient $\mu$ of friction is produced by:

$$\mu=\{1n(F/0.98)\}/(\pi/2) \quad (1)$$

When a lubricant or similar agent was not applied to the surface of the drum 1, the maximum static coefficient of friction $\mu$ was measured to range from 0.5 to 0.6 and tended to increase with time. By contrast, the drum 1 applied with a lubricant was found to have a maximum static coefficient of friction between 0.1 and 0.4.

In the illustrative embodiment, the drum 1 and the developing roller 402 contact each other via a toner layer deposited on the roller 402. The developing roller 402 should preferably be pressed against the drum 1 by a spring, particularly by a plurality of springs in order to reduce irregular contact. The springs may be implemented by coil springs or leaf springs by way of example. When the surface hardness of the developing roller 402 is, e.g., 30° as measured by JIS (Japanese Industrial Standards) A scale, the developing roller 402 should preferably be pressed against the drum 1 by a linear pressure of 9.8 N/m to 128 N/m (1 gf/mm to 16 gf/mm). Further, the number of springs or biasing means should preferably be as large as possible for scattering the pressure.

FIG. 20 shows the results of experiments conducted to determine a relation between the contact pressure of the developing roller 402 and the developing characteristic (uniform solid image and background contamination). For the experiments, use was made of photoconductive drums coated with zinc stearate, photoconductive drums coated with silicone oil, and photoconductive elements not coated with any lubricant. The developing roller 402, which was 50 mm wide in the axial direction, was pressed against each drum 1 by a load of 150 g to 900 g. The surface layer of the developing roller 402 was implemented by silicone rubber.

In FIG. 20, "0.035" and other numerical values are ΔID values representative of the degrees of background contamination. The ΔID values are measured by the following procedure. After toner deposited on the background of the drum 1 has been transferred to a transparent adhesive tape, the reflection characteristic of the adhesive tape is measured. The intensity of incident light Iin and the intensity of reflected light Ir are measured and used to produce optical density ID (subject):

$$ID=\log_{10}(ir/Iin) \quad (2)$$

Likewise, optical density (ID) is determined with the adhesive tape or reference sample. ΔID whose target value is 0.02 or below is expressed as:

$$\Delta ID=ID\ (\text{subject})-ID\ (\text{reference}) \quad (3)$$

In FIG. 20, parenthesized A, B and C are representative of defective images and respectively correspond to banding, the omission of a leading edge, and irregular solid image.

As FIG. 20 indicates, background contamination can be obviated if a lubricant is applied to the surface of the drum 1 so as to provide it with the maximum static coefficient of friction of 0.4 or below.

If the maximum static coefficient of friction $\mu$ is smaller than 0.1, then the scavenging force of the developing roller 402, which rotates with the previously mentioned linear velocity ratio to the drum 1, increases and prevents toner from being sufficiently transferred from the developing roller 1 to the drum 1. The resulting image is low density and therefore low quality. On the other hand, if the maximum static coefficient of friction $\mu$ is greater than 0.4, then the background of the drum 1 is easily contaminated. This may be coped with by increasing the pressure of the developing roller 402 to act on the drum 1 or by increasing the linear velocity ratio of the roller 402 to the drum 1. This kind of scheme, however, is apt to bring about banding and other defects.

How a latent image is formed on the drum 1 will be described in detail hereinafter. In the illustrative embodiment, the exposing device 3 is configured to write a latent image with a smaller beam spot diameter and a greater amount of energy than the conventional optical writing system. The optical writing condition of the illustrative embodiment will be described by using the differential sensitivity S of the drum 1 as a parameter. Assume that a light beam having the same wavelength as the light beam to issue from the exposing device 3 uniformly exposes the drum 1. Then, the differential sensitivity S is defined by a relation between the surface potential V (E) of the drum 1 and the amount of exposure E. More specifically, assume that the drum 1 is exposed by a given amount of exposure E, and that when the amount E is increased by a small value ΔE, the surface potential of the drum 1 is V(E+ΔE). Then, the differential sensitivity is expressed as:

$$S=|V(E+\Delta E)-V(E)|/\Delta E \quad (4)$$

Generally, the differential sensitivity S decreases with an increase in the amount of exposure E. A value that sufficiently reduces the differential sensitivity refers to an amount of exposure that can use the range of attenuation characteristic of the drum 1 sufficient to attain desired stability. As for desired stability, assume a bilevel process that expresses the tonality of an image in terms of the density of, among pixels constituting the image, pixels on which toner is to deposit for a unit area. Then, the above-mentioned desired stability refers to the fact that a plurality of dots having the same diameter and having preselected density can be formed and do not noticeably vary with time. In practice, however, image density sometimes becomes short due to an increase in potential after exposure, which is ascribable to the aging of the drum 1. The amount of exposure insuring potential after exposure, which does not lower image quality, is the amount that sufficiently reduces the differential sensitivity. In the aspect of development, it is preferable to develop the latent image formed on the drum to saturation, so that a plurality of dots with the same diameter and the preselected density can be formed.

Figure 4:
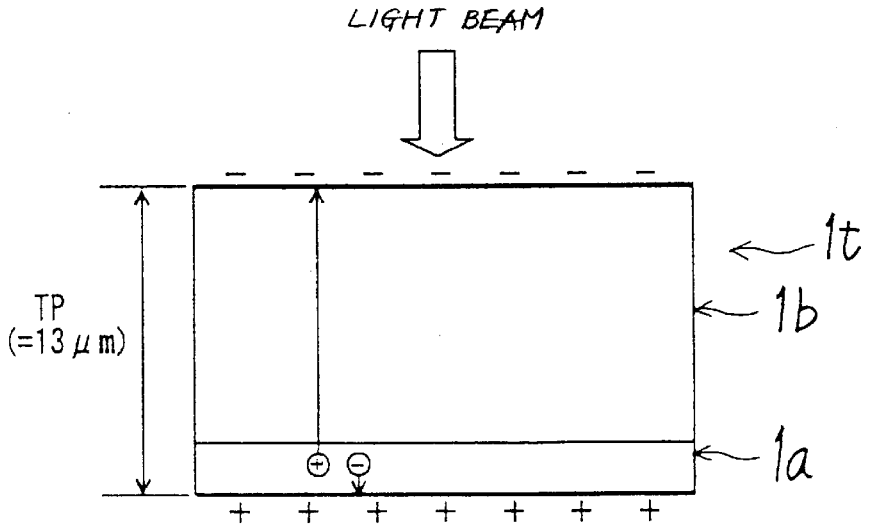
FIG. 4 is a section showing a photoconductive layer included in the photoconductive element.

FIG. 4 shows a photoconductive layer 1*t* included in the drum 1. As shown, the photoconductive layer 1*t* is made up of a charge generation layer 1*a* and a charge transport layer 1*b* and has an overall thickness TP of 14 $\mu$m. The thickness TP of the photoconductive layer 1*t* and the spot diameter Db of the light beam are selected to satisfy a relation:

$$2TP<Db<8TP \quad (5)$$

As for the spot diameter DB of the light beam, assume coordinates (x,y) on the surface of the drum 1. Then, an exposure distribution E(x,y) (j/m$^2$) defined by integrating the energy distribution P(x,y,t) (W/m$^2$) of the light beam by the duration of exposure is expressed as:

$$E(x,y)=\int P(x,y,t)dt \quad (6)$$

The spot diameter Db is the minimum diameter when the above distribution E(x,y) is 1/e$^2$ of the peak value.

Figure 5:
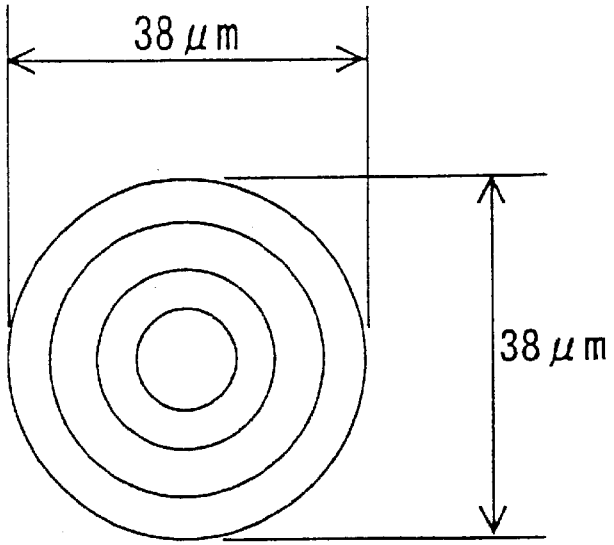
FIG. 5 shows the distribution of the amount of exposure measured on the photoconductive element.

Reference will be made to FIG. 5 for describing the distribution of the amount of exposure on the drum 1. Assume that the drum 1 is scanned by about 20 $\mu$m in the subscanning direction in order to form a single pixel of latent image. Then, in the illustrative embodiment, the spot diameter of the light beam is about 38 $\mu$m in both of the main and subscanning directions in the distribution of the amount of exposure. That is, the light beam approximately shows a 38 $\mu$m Gauss distribution in both of the main and subscanning directions. It follows that the exposure diameter Db of the light beam defined as the minimum diameter when the distribution E is 1/e$^2$ of the peak is 38 $\mu$m.

Figure 6:
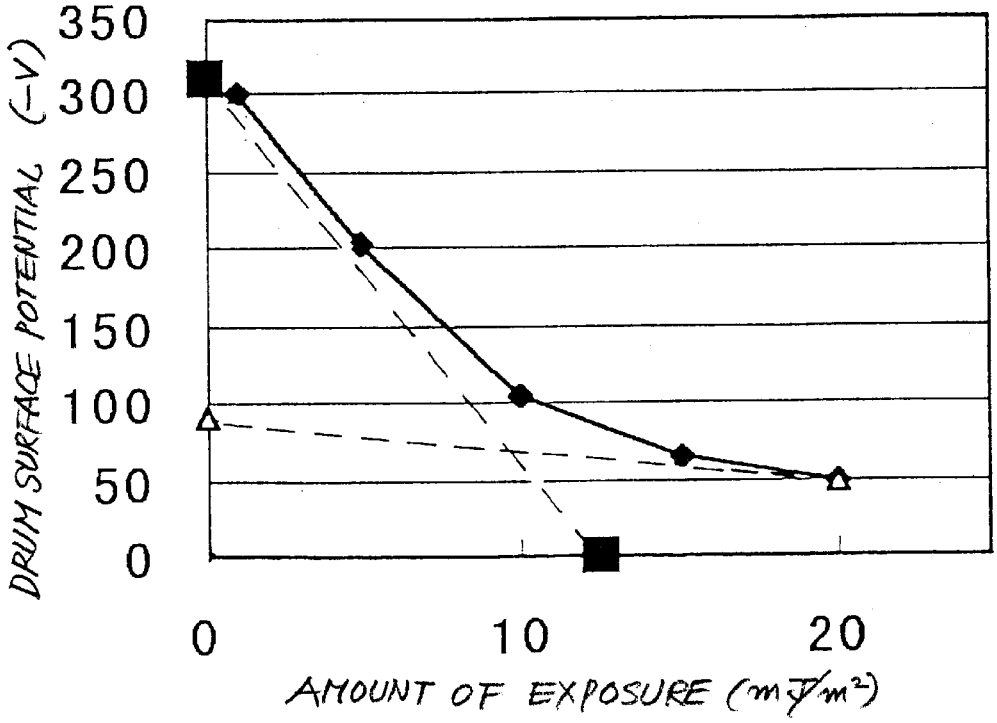
FIG. 6 is a graph showing a relation between the amount of exposure and the surface potential of the photoconductive element.

FIG. 6 shows an experimentally determined relation between the amount of exposure and the attenuation characteristic of the surface potential of the drum 1. In FIG. 6, rhombs are representative of actually measured data while squares, triangles and dashed lines connecting them are used to describe differential sensitivity. In the illustrative embodiment, the exposing device 3 emits a light beam having a wavelength of 670 nm and having power of 0.23 mW as measured on the surface of the drum 1. In this condition, there can be implemented the amount of exposure for the peak value of the exposure distribution, i.e., the maximum amount of exposure within the diameter of Db that sufficiently reduces the differential sensitivity of the photoconductive layer 1*t*.

As for the attenuation characteristic shown in FIG. 6, the maximum differential sensitivity is 28 V.m$^2$/mJ. The amounts of exposure E corresponding to one-third of the maximum differential sensitivity or below are the values that sufficiently reduce the differential sensitivity. In this connection, in FIG. 6, the peak of the exposure E is 20 mJ/m$^2$ while the differential sensitivity corresponding to the peak is 5 V.m$^2$/mJ. This differential sensitivity is about one-fifth of the maximum value.

Figure 7:
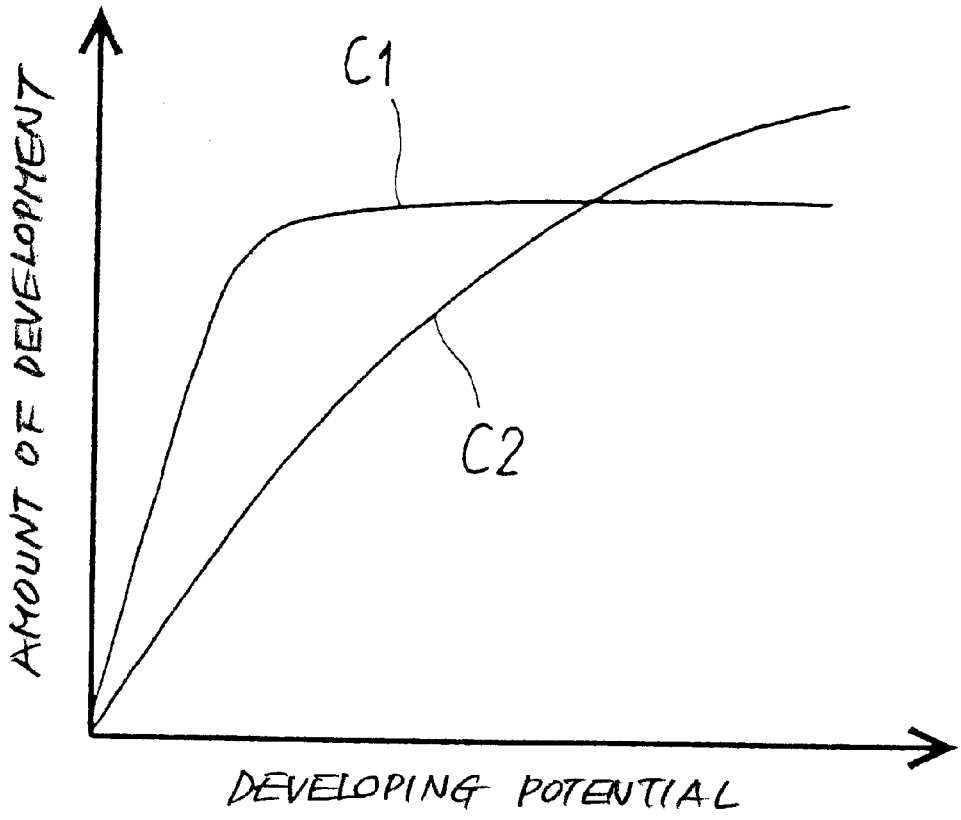
FIG. 7 is a graph showing a relation between the developing potential and the amount of development (γ curves)

In the illustrative embodiment, the developing roller 402 has a volume resistivity of 103 Ωcm, which is lower than the resistivity of the conventional developing device using a single-ingredient type developer, i.e., toner. The developing roller 402 therefore has a developing characteristic whose γ curve (amount of development for a given developing potential) is represented by a curve C1 shown in FIG. 7. As shown, the γ curve C1 sharply increases at the beginning and saturates soon because development is easy to occur at a relatively low potential. For comparison, FIG. 7 shows a γ curve C2 representative of the development characteristic of the conventional developing device using toner.

With the developing roller 402 having the development characteristic represented by the curve C1, it is relatively easy to deposit a constant amount of toner on the developing roller 402 and to develop a solid image with all the toner existing on the roller 402. As for a small dot, however, the amount of development is apt to vary if the conventional drum and various writing conditions fail to sufficiently reduce the differential sensitivity, causing the dot diameter to vary. By contrast, the illustrative embodiment sufficiently reduces the differential sensitivity when the dot diameter is defined by $1/e^2$, and therefore insures dots with a uniform diameter and sufficient density.

The developing device 4 will be described more specifically with reference to FIG. 8. As shown, the developing device 4 includes a casing 401. The developing roller or developer carrier 402, a magnet brush roller or toner supplying member 403 and agitating and conveying members 404 and 405 are sequentially arranged in the casing 401, as named from the drum 1 side. The casing 401 stores a two-ingredient type developer 12 made up of toner 10 and magnetic particles 11. The agitating and conveying members 404 and 405 agitate the developer 12. Part of the agitated developer 12 deposits on the magnet brush roller 403. The developer 12 deposited on the magnet brush roller 403 is regulated in thickness by a doctor blade 406 and then brought into contact with the developing roller 402 in a toner supplying region A2. In the toner supplying region A2, only the toner 10 is separated from the developer 12 and transferred to the developing roller 402.

In the illustrative embodiment, the drum 1 has a base formed of aluminum and is therefore rigid, as stated earlier. It is therefore preferable to use rubber having hardness of 10° to 70° (JIS A scale) for the developing roller 402. Also, the developing roller 402 should preferably have a diameter of 10 mm to 30 mm. In the illustrative embodiment, the diameter is selected to be 16 mm. The developing roller 402 is provided with surface roughness Rz (ten-point mean roughness) of 1 μm to 4 μm. Such a surface roughness range is 13% to 80% of the volumetric mean grain size of the toner 10 and allows the toner 10 to be conveyed without being buried in the surface of the developing roller 402. As for rubber that constitutes the developing roller 402, use may be made of silicone rubber, butadien rubber, NBR (nitril rubber), hydrine rubber or EPDM (ethylene-propylene-dien rubber) by way of example. When the photoconductive element is implemented as a rubber, the developing roller 402 may be formed of metal because its hardness does not have to be lowered. The surface of the developing roller 402 may advantageously be covered with a suitable coating material in order to enhance stability against aging.

Further, in the illustrative embodiment, the developing roller 402 should only deposit the toner 10 thereon and does not have to charge the toner by friction 10. The developing roller 402 therefore should only satisfy electric resistance, surface configuration, hardness and dimensional accuracy, so that a broad range of materials are usable.

The material coating the developing roller 402 may be chargeable to polarity opposite to the polarity of the toner 10 or to the same polarity as the toner 10 if the roller 402 does not function to charge the toner 10 by friction. The material chargeable to polarity opposite to the polarity of the toner 10 is, e.g., a material containing silicone resin, acryl resin, polyurethane resin or rubber. Typical of the material chargeable to the same polarity as the toner 10 is fluorine. Teflon materials containing fluorine have inherently low surface energy and a desirable parting ability and therefore cause a minimum of filming ascribable to aging to occur.

Resins in general usable as the coating material include polytetrafluoroethylene (PTFE), tetrafluoroethylene perfluoroalkyl vinylether, (PFA), tetrafluoroethylene-hexafluoropropylene copolymer (FEP), plychlorotrifluoroethylene (PCTFE), tetrafluoroethylene-ethylene copolymer (ETFE), chlorotrifluoroethylene-ethylene copolymer (ECTFE), polyvinylidenefluoride (PVDF), and polyvinylfluoride (PVF). Carbon black or similar conductive substance is often added to such resins in order to provide them with conductivity.

As for electric resistance, a bulk volume resistivity, including the resistivity of the coating layer, is set. The resistance of the base is adjusted such that the bulk volume resistivity can be $10^3$ Ω.cm to $10^8$ Ω.cm. In the illustrative embodiment, the base has a volume resistivity between $10^3$ Ω.cm and $10^5$ Ω.cm, so that a relatively high volume resistivity may be selected for the surface layer.

Figure 9A:
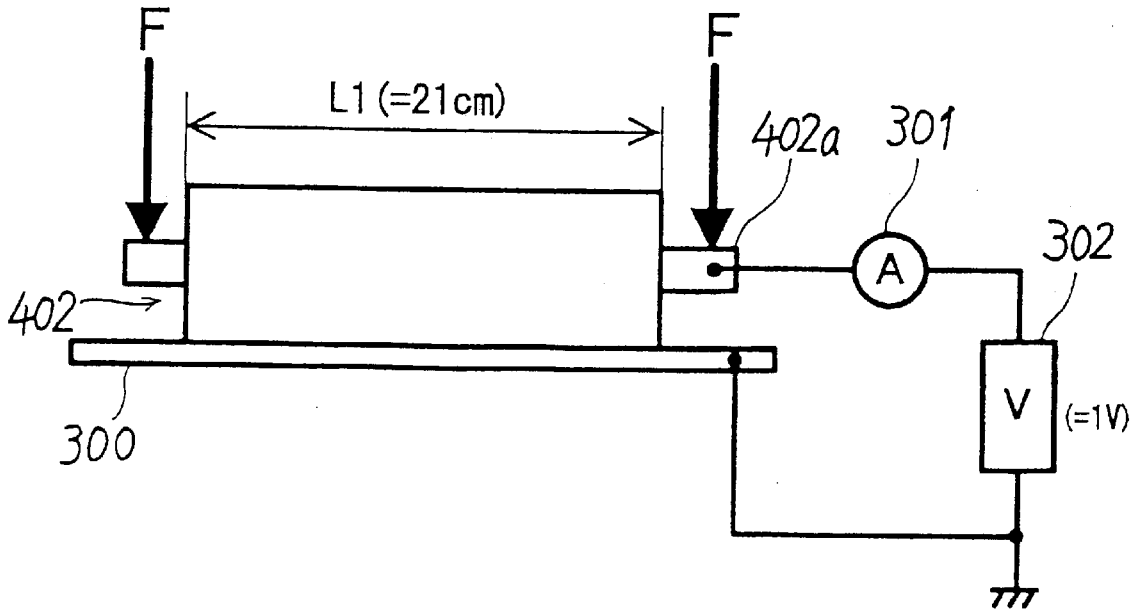
FIGS. 9A and 9B are views showing a specific arrangement for measuring the volume resistivity of the surface of a developing roller included in the developing device.
Figure 9B:
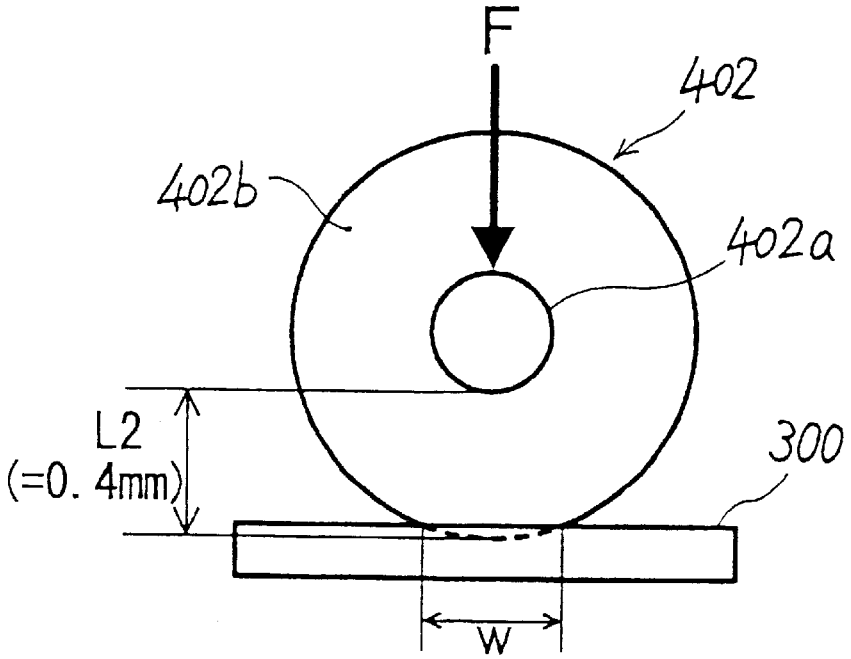

FIGS. 9A and 9B show a specific arrangement for measuring the volume resistivity of the surface of the developing roller 402. As shown, the roller 402 is set on a conductive base plate 300 connected to ground. A load F of 4.9 N (=500 gf) is applied to opposite ends of the core (shaft) 402*a* of the roller 402, i.e., F=9.8 N (1 kgf) is applied in total. In this condition, as shown in FIG. 9B, the roller 402 form a nip W between it and the base plate 300. A power supply 302 is connected to the core 402*a* via an ammeter 301 so as to apply a DC voltage V (=1 V) to the core 402*a*. The resulting current I (A) is read on the ammeter 301. The voltage V (V), measured current I (A), various dimensions L1 and L2 (cm) and measured nip width W (cm) are used to determine the volume resistivity ρv of an elastic layer 402*b* included in the roller 402:

$$\rho v=(V/I)\cdot(L1\times W)/L2 \tag{7}$$

The coating layer covering the developing roller 402 should preferably be 5 μm to 50 μm thick. Thickness exceeding 50 μm is apt to crack or otherwise damage the coating layer due to stress when the coating layer and base are noticeably different in hardness from each other. Thickness less than 5 μm is apt to expose the base to the outside and cause toner to easily deposit as the surface of the roller 402 wears.

The toner 10 is a mixture of polyester resin, plyol resin, styrene-acryl resin or similar resin, a charge control agent (CCA) and a coloring agent. Further, each toner particle is coated with silica, titanium oxide or similar fluidity enhancing agent. The fluidity enhancing agent usually has a grain size of 0.1 mμ to 1.5 μm. The coloring agent may be carbon black, phthalocyanine Blue, quinacrydone, carmine or the like. Alternatively, each toner particle may consist of a mother particle in which wax, for example, is dispersed and the above additive that coats the mother particle.

The toner 10 has a volumetric mean grain size that is preferably between 3 μm and 12 μm. In the illustrative embodiment, the volumetric mean grain size is 7 μm that can sufficiently deal with images whose resolution is as high as 1,200 dpi or above.

While the illustrative embodiment uses the toner 10 chargeable to negative polarity, use may be of toner chargeable to positive polarity in accordance with the polarity of charge expected to deposit on the drum 1.

The magnetic particles 11 each consist of a metal or resin core containing ferrite or similar magnetic material and coated with, e.g., silicone resin. Each magnetic particle 11 should preferably have a size of 20 $\mu$m to 50 $\mu$m and resistance of $10^4$ Ω to $10^8$ Ω in terms of dynamic resistance DR.

Figure 10:
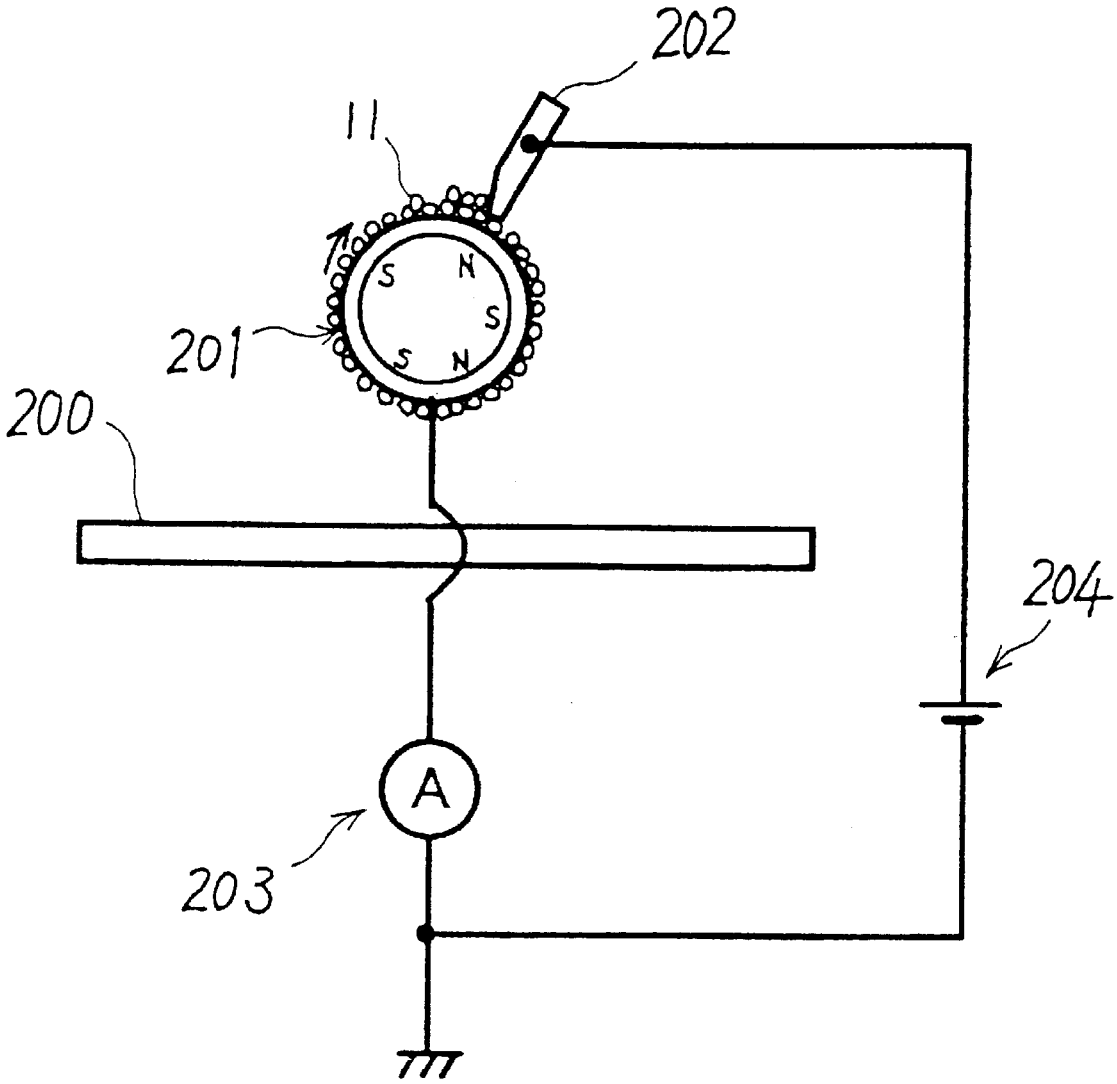
FIG. 10 is a view showing a specific arrangement for measuring the dynamic resistance of magnetic particles included in a developer.

FIG. 10 shows a specific arrangement used to measure the dynamic resistance DR of the magnetic particles 11. As shown, a rotatable sleeve 201 having a diameter of 20 mm and accommodating magnets at preselected positions is set above a stage 200, which is connected ground. A doctor or facing electrode 202 faces the surface of the drum 201 via a gap g of 0.9 mm over a width W of 65 mm and a length L of 0.5 mm to 1 mm. While the sleeve 201 is rotated at a speed of 600 rpm (revolutions per minute) (linear velocity of 528 mm/sec), 14 g of magnetic particles are deposited on the sleeve 201 and agitated thereby for 10 minutes.

Subsequently, while a voltage is not applied to the sleeve 201, a current Ioff (A) flowing between the sleeve 201 and the facing electrode 202 is measured by an ammeter 203. Thereafter, a voltage E (V) of the upper limit voltage level is applied from a DC power supply 204 to the sleeve 201 for 5 minutes. The upper limit voltage level is 400 V in the case of a high resistance, silicone-coated carrier or several volts in the case of an iron powder carrier. In the illustrative embodiment, the voltage E is selected to be 200 V. While the voltage E is continuously applied, a current Ion (A) flowing between the sleeve 21 and the facing electrode 202 is measured by the ammeter 203. A dynamic resistance DR (Ω) is calculated by using the results of the above measurements:

$$DR=E/(I\text{on}-I\text{off}) \quad (8)$$

Figure 8:
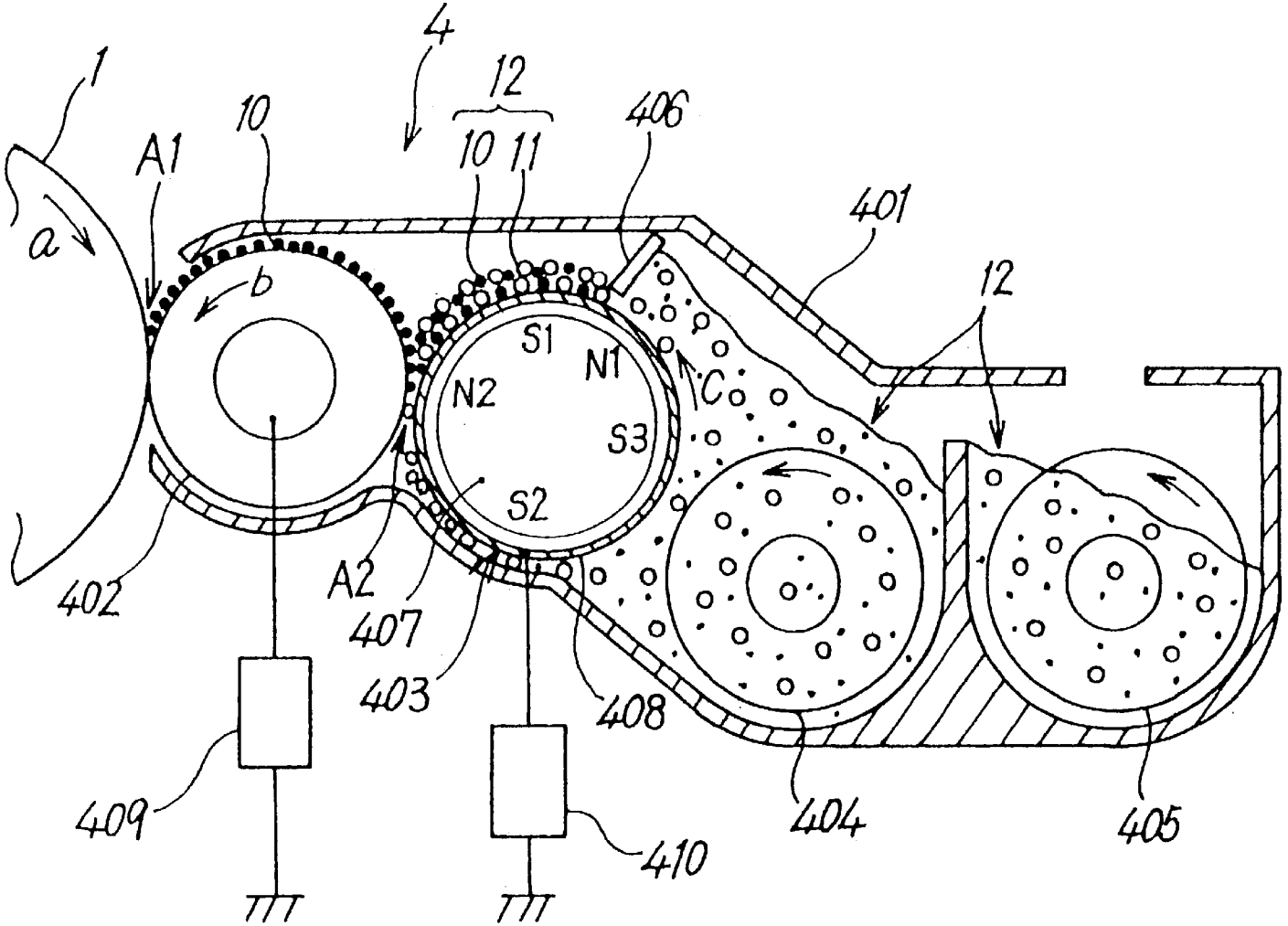
FIG. 8 is a view showing a developing device included in the illustrative embodiment.

As shown in FIG. 8, the magnet brush roller 403 has a nonmagnetic, rotatable sleeve 408 accommodating a magnet member 407 therein. The magnet member 407 has a plurality of magnetic poles N1, S1, N2, S2 and S3, as named in the direction of rotation of the roller 403. The magnet member 407 is held stationary and exerts magnetic forces on the developer 12 when the developer 12 passes preselected positions on the sleeve 408. In the illustrative embodiment, the sleeve 408 has a diameter of 18 mm and is roughened by sand blasting so as to have surface roughness Rz of 10 $\mu$m to 20 $\mu$m.

Figure 11:
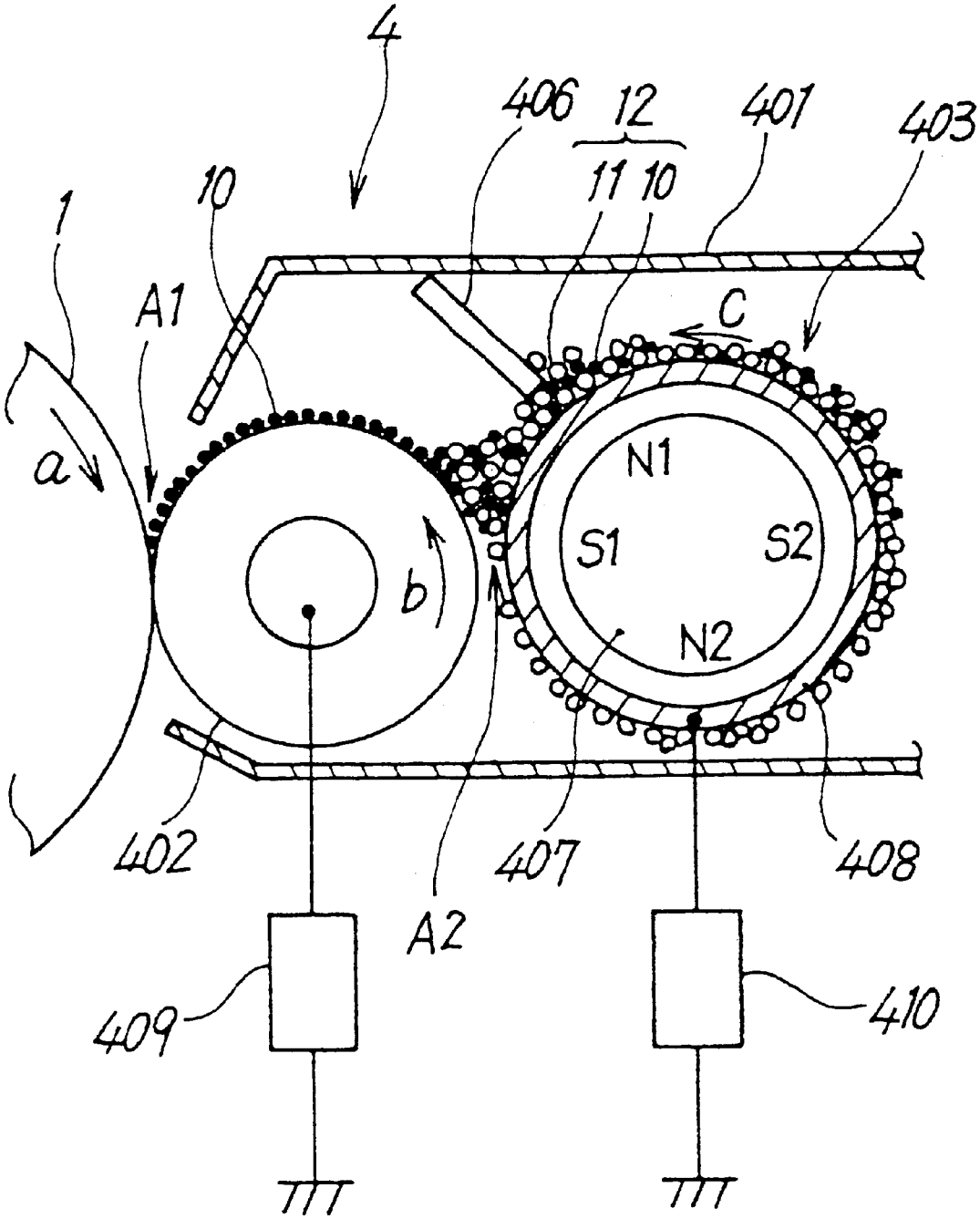
FIG. 11 is a view showing a modification of the developing device.

The arrangement of the magnetic poles shown in FIG. 8 is only illustrative and may be replaced with any other suitable arrangement in accordance with the position of, e.g., the doctor blade 406. For example, as shown in FIG. 11, four magnetic poles N1, S1, N2 and S2 may be sequentially arranged in this order in the direction of rotation of the roller 403, as seen from a position where the doctor blade 406 is located.

Further, in FIG. 8, the magnetic member 407 is stationary while the sleeve 408 is rotatable relative to the magnetic member 407. Alternatively, the magnet member 407 may be rotated relative to the sleeve 408 that is held stationary.

The magnetic force of the magnet member 407 causes the toner 10 and magnetic particles 13 to deposit on the sleeve 408 in the form of a magnet brush. The toner 10 obtains a preselected amount of charge by being mixed with the magnetic particles 11. The amount of charge to deposit on the toner on the magnet brush roller 403 should preferably be between −10 $\mu$C/g to −40 $\mu$C/g.

The developing roller 402 faces the magnet brush formed on the magnet brush roller 4 in the toner supplying region A2, which adjoins the magnetic pole N2. Also, the developing roller 402 faces the drum 1 in the developing region A1.

In the illustrative embodiment, the distance between the doctor blade 406 and the magnet brush roller 403 is selected to be 500 $\mu$m, as measured at the position where the blade 406 and roller 403 are closest to each other. Further, the pole N1 adjoining the doctor roller 406 is shifted by several degrees from the position where the pole N1 faces the blade 406 in the direction of rotation of the magnet brush roller 403. This allows the developer 12 to easily circulate in the casing 401.

The doctor blade 406 contacts the magnet brush in such a manner as to regulate the amount of the developer 12 at a position where it faces the brush roller 403. The developer is fed to the toner supplying region A2 in a preselected amount. The doctor blade 406 promotes the frictional charging of the toner 10 and magnetic particles 11.

The developing roller 402 and magnet brush roller 403 are respectively rotated in directions b and c shown in FIG. 8 by respective drivelines. The surface of the developing roller 402 and that of the magnet brush roller 403 move in opposite directions to each other, as seen in the toner supplying region A2. In the illustrative embodiment, the drum 1 and developing roller 402 are driven at linear velocities of 200 mm/s and 300 mm/s, respectively.

In the illustrative embodiment, the developing roller 402 and magnet brush roller 403 are spaced from each other by 0.6 mm, as measured in the toner supplying region A2.

A power supply 409 is connected to the shaft of the developing roller 402 and applies a bias Vb for development thereto, forming an electric field in the developing region A1. Likewise, a power supply 410 is connected to the sleeve 408 and applies a bias Vsup for toner supply thereto, forming an electric field in the toner supplying region A2.

The operation of the developing device 4 having the above-described configuration will be described hereinafter. The developer 12 stored in the casing 401 is the mixture of toner 10 and magnetic particles 11, as stated earlier. The rotation of the agitating and conveying members 404 and 405, the rotation of the sleeve 408 and the magnetic force of the magnet member 407 cooperate to agitate the developer 12 and thereby frictionally charge the toner 10.

On the other hand, the doctor blade 406 regulates the developer 12 deposited on the magnet brush roller 403. The developer 12 is therefore transferred to the developing roller 402 in a preselected amount due to, e.g., the electric field formed in the toner supplying region A2. The rest of the developer 12 is returned to the casing 401.

In the toner supplying region A2, the toner is separated from the magnet brush and transferred to the developing roller 402, forming a thin layer on the roller 402. The developing roller 402 in rotation conveys the toner 10 to the developing region A1. In the developing region A1, the electric field for development causes the developer 10 to selectively deposit on the drum 1, developing a latent image formed on the drum 1.

The amount of charge to deposit on the toner on the magnet brush roller 403 and that of charge to deposit on the toner on the developing roller 402 will be described in comparison with a conventional developing device using a single-ingredient type developer.

FIG. 21 shows the results of experiments conducted with the illustrative embodiment and a conventional developing device using a single-ingredient type developer. For the experiments, the two developing devices stored developers containing the same toner. There were measured the amount of charge deposited on the toner on the magnet brush roller 403 and that of charge deposited on the toner on the conventional toner supply roller as well as the amount of charge deposited on the thin toner layer on the developing roller 402 and that of charge deposited on the thin toner layer on the conventional developing roller. In FIG. 21, background contamination ranks were determined on the basis of the measured ΔID values. For example the background contamination rank is "3" if the ΔID value is 0.08 to 0.04.

In the conventional developing device, the amount of toner to deposit on the developing roller is as great as 1 $mg/cm^2$ to 3 $mg/cm^2$. Although a doctor blade scrapes off part of such toner, the toner with a great amount of charge presumably passes the doctor blade. As a result, as shown in FIG. 21, the mean amount of charge to deposit on the toner when the toner actually formed a thin layer was as great as −12 μC/g, but the background contamination rank was "3" or average rank, as confirmed in an image.

By contrast, in the illustrative embodiment, although the mean amount of charge to deposit on the toner on the developing roller 402 was also −12 μC/g, the background contamination rank was as high as "5". The illustrative embodiment is therefore superior in image characteristic to the conventional developing device.

Hereinafter will be describes the results of some different experiments conducted to determine a relation between the grain size and charge distribution of the toner deposited on the developing roller 402 and image quality.

For the measurement of grain size and charge distribution, use was made of an analyzer E-SPART ANALYZER available from HOSOKAWA MICRON CORP. (E-SPART analyzer hereinafter). The E-SPART analyzer uses a method using a double beam, frequency displacement, laser Doppler speedometer and an acoustic wave that perturbs particles in a static electric field. While air is sent to the toner deposited on the developing roller 402 so as to blow it off, the E-SPART analyzer grasps the movement of the toner in an electric field and thereby outputs data representative of the size of the individual toner particle and the amount of charge deposited thereon. For experiment, 3,000 toner particles were sampled in order to determine differences in distribution.

If the charge deposited on the individual toner particle is uniformly distributed, then the amount of charge is proportional to the third power of the particle size. In practice, however, the amount of charge is proportional to the particle size itself. In this manner, the amount of charge and particle size are proportional to each other. In light of this, the distribution of the number of toner particles was measured by mainly using a value q/d where q and d denote the amount of charge deposited on the toner and the particle size, respectively. The value q/d is free from the influence of the particle size.

Figure 12:
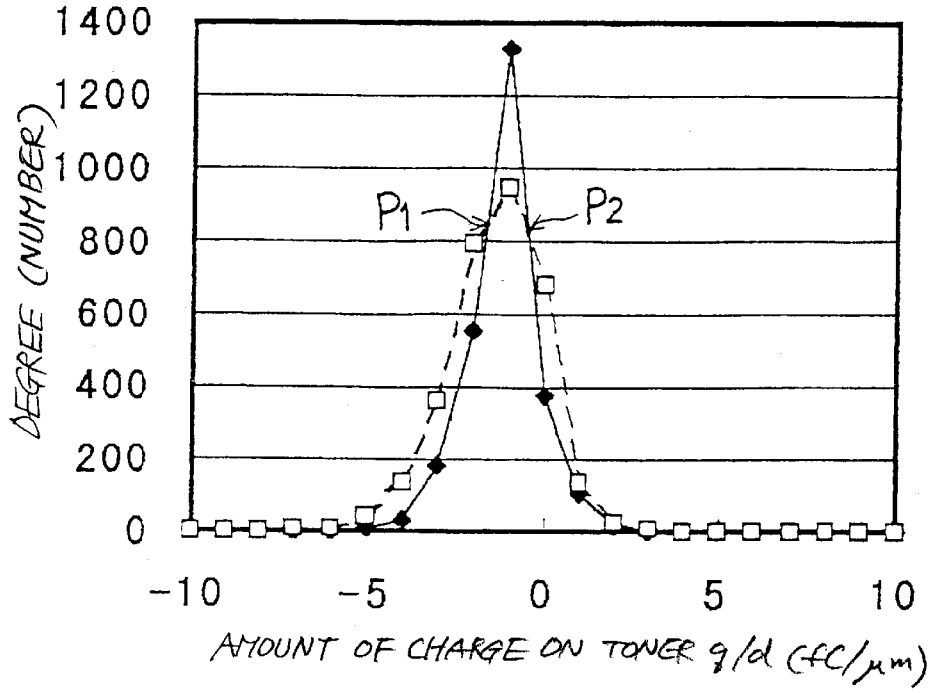
FIG. 12 is a graph showing the charge distributions of toner deposited on the developing roller and measured by experiments.

FIG. 12 shows charge distributions toner deposited on the developing roller 402 measured by the E-SPART analyzer. In FIG. 12, rhombs are representative of data particular to the illustrative embodiment while squares are representative of data particular to a conventional developing unit using a single-ingredient type developer, but not using a magnetic brush roller. As FIG. 12 indicates, the charge distribution profile attainable with the illustrative embodiment is sharper than the distribution profile available with the conventional developing device.

Generally, a half width is used as an index representative of the sharpness of the charge distribution profile. The profile is considered to be sharper when the half width is smaller. Generally, a sharp charge distribution profile means that many toner particles with similar amounts of charge q/d exist. Such toner particles are equal in developing ability and can therefore uniformly develop a latent image. Conversely, a broad charge distribution profile extends the range of the amount of charge and therefore the range of the developing ability, causing the amount of development to vary.

By studying FIG. 12 in detail, it will be seen that the conventional q/d distribution has many particles distributed outside of points P1 and P2 where the two curves intersect each other, compared to the q/d distribution of the illustrative embodiment. In the range at the left-hand side in FIG. 12 where the absolute value of q/d is great, the amount of charge and therefore a force contributing to development is great. However, not much of the toner can be transferred for development because the electric field for development attenuates as the development proceeds, so that part of the toner remains on the developing roller. On the other hand, in the range at the right-hand side in FIG. 12 where the absolute value of q/d is small, the amount of charge depends on the amount of charge deposited on the drum 1 and is likely to increase the amount of development. In addition, toner particles of short charge or opposite charge exist and are likely to contaminate the background.

As for the ratio of the number of particles in the portion where the toner charge q/d flares, as in the illustrative embodiment, the degrees (number of particles) of channels at opposite sides of a channel having a peak value should optimally be 50% or less of the number of particles of the channel with the peak value. In this manner, the illustrative embodiment achieves a sharp q/d distribution that insures uniform development and therefore high image quality. In this connection, the degrees (number of particles) of channels at opposite sides of a channel having a peak value was 78% of the number of particles of the channel with the peak value in the conventional developing device using a single-ingredient type developer. By contrast, the illustrative embodiment successfully reduced the above ratio to 35%. The interval between the channels at opposite sides of the channel with the peak value and the channel with the peak value was 1 fC/10 μm.

Figure 13:
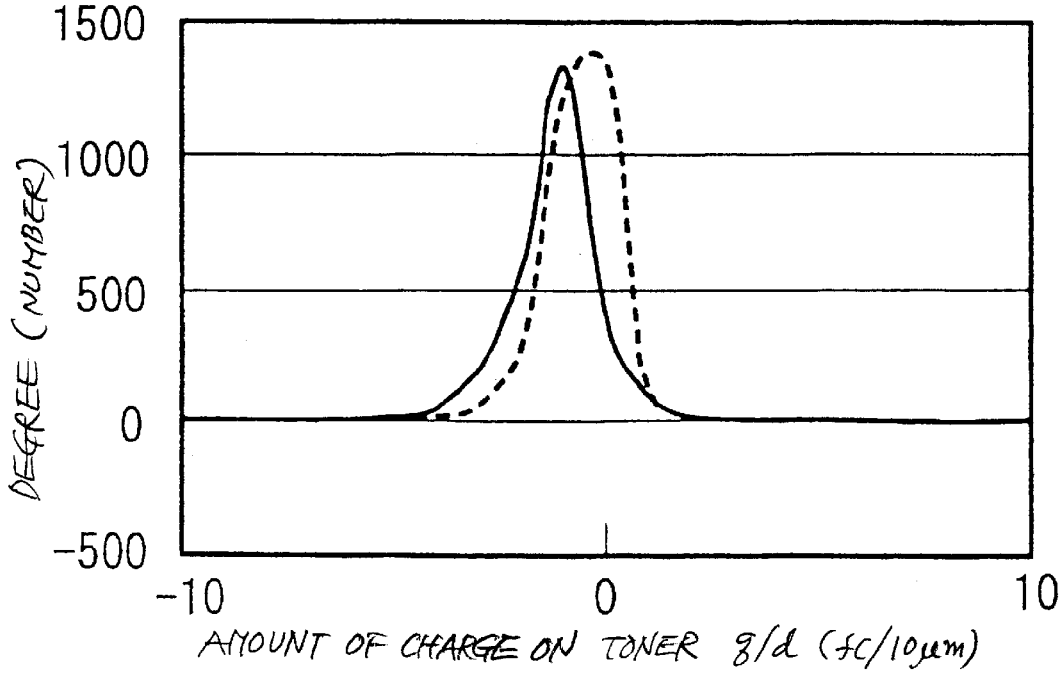
FIGS. 13 through 15 are graphs each showing a relation between the charge distribution of toner deposited on a magnet brush roller also included in the illustrative embodiment and the charge distribution of toner deposited on the developing roller determined in a particular condition.
Figure 14:
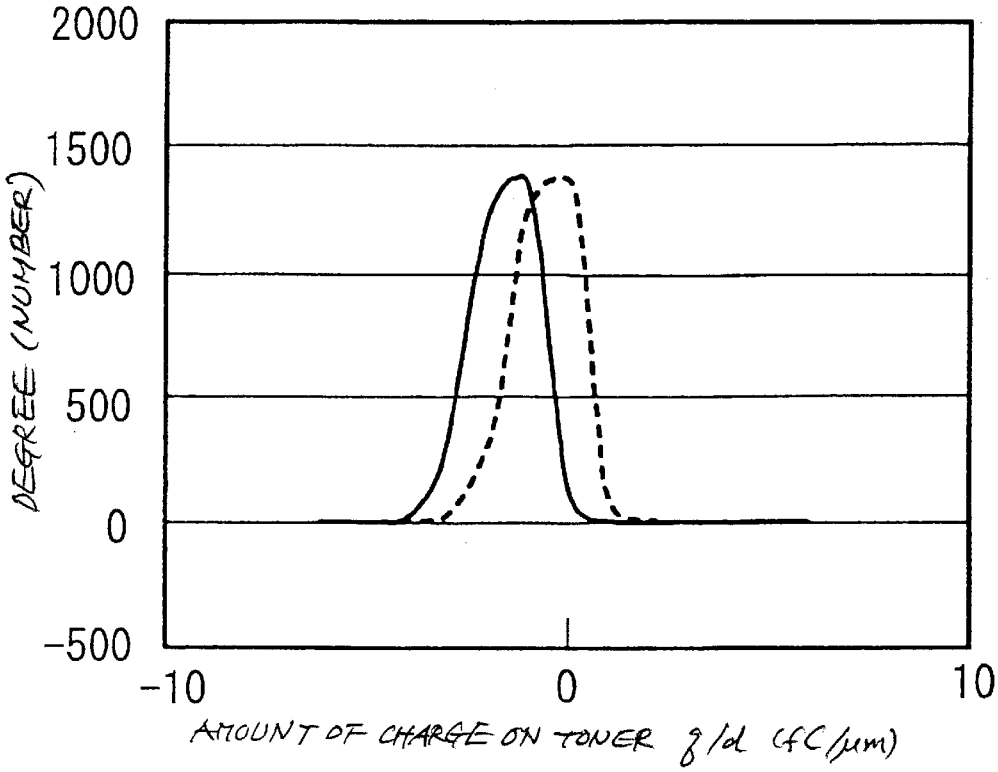
Figure 15:
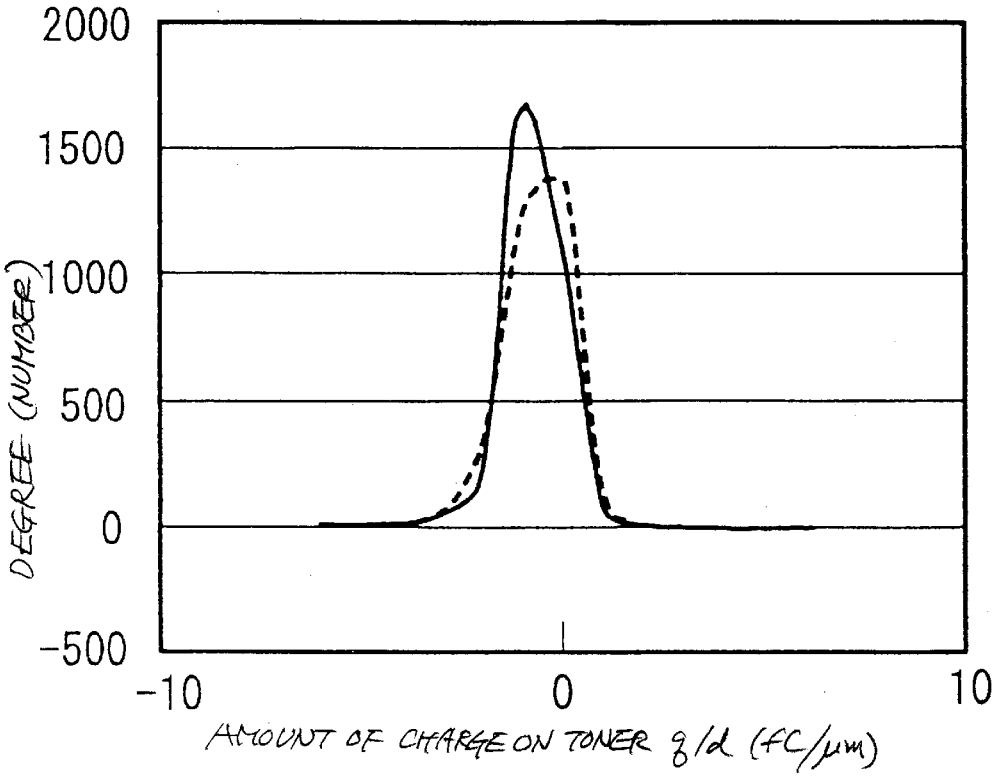

FIGS. 13 through 15 each show a relation between the charge distribution of the toner deposited on part of the magnet brush roller 403 that is about to enter the toner supplying region A2 and the charge distribution of toner fed to the developing roller 402, as determined by experiments. In FIGS. 13 through 15, solid curves and phantom curves respectively indicate data determined with the illustrative embodiment and data determined with the conventional developing device using a single-ingredient type developer and not including the magnet brush roller. As for the solid curves, measurement was made by varying the toner supply potential Δsup and the material constituting the surface of the developing roller 402, as listed in FIG. 22. The toner supply potential Δsup was calculated by using the bias Vb for development and the bias Vsup for toner supply:

$$\Delta Vsup = Vb - Vsup \quad (9)$$

As for the experimental results shown in FIG. 13, the charge distribution of toner on the developing roller 402 has a sharper profile than the charge distribution on the magnet brush roller 403 around the peak. This is presumably because the high toner supply potential between the two rollers caused much toner to be supplied from around the peak of the charge distribution profile. Why the distribution is generally shifted to the higher charge side in absolute value is presumably that silicone rubber forming the surface of the developing roller 402 charged the toner to negative polarity by friction.

As for the experimental results shown in FIG. 14, the charge distribution profile of toner on the developing roller 402 is generally shifted to the higher charge side in absolute value. This is presumably because silicone rubber forming the surface of the developing roller 402 charged the toner to negative polarity by friction. Why the charge distribution profiles on the two rollers resemble each other is presumably that the toner supply potential influences little.

As for the experimental results shown in FIG. 15, the charge distribution profile of toner on the developing roller 402 is sharper than the charge distribution profile on the magnet brush roller 403 in the skirt portion. This is presumably because the high toner supply potential between the two rollers reduced the number of toner particles charged to the opposite polarity and caused much toner to be transferred from around the peak of the peak of the profile. Why the profile is scarcely shifted to the high potential side is that the surface of the developing roller 402 was formed of urethane resin that charged the toner by friction little.

As stated above, if the material for the surface of the developing roller 402 is adequately selected and if the toner supply potential is adequately adjusted, the charge distribution profile of toner on the developing roller 402 can be provided with a desired profile without regard to the charge distribution profile of toner on the magnet brush roller 403.

Figure 16:
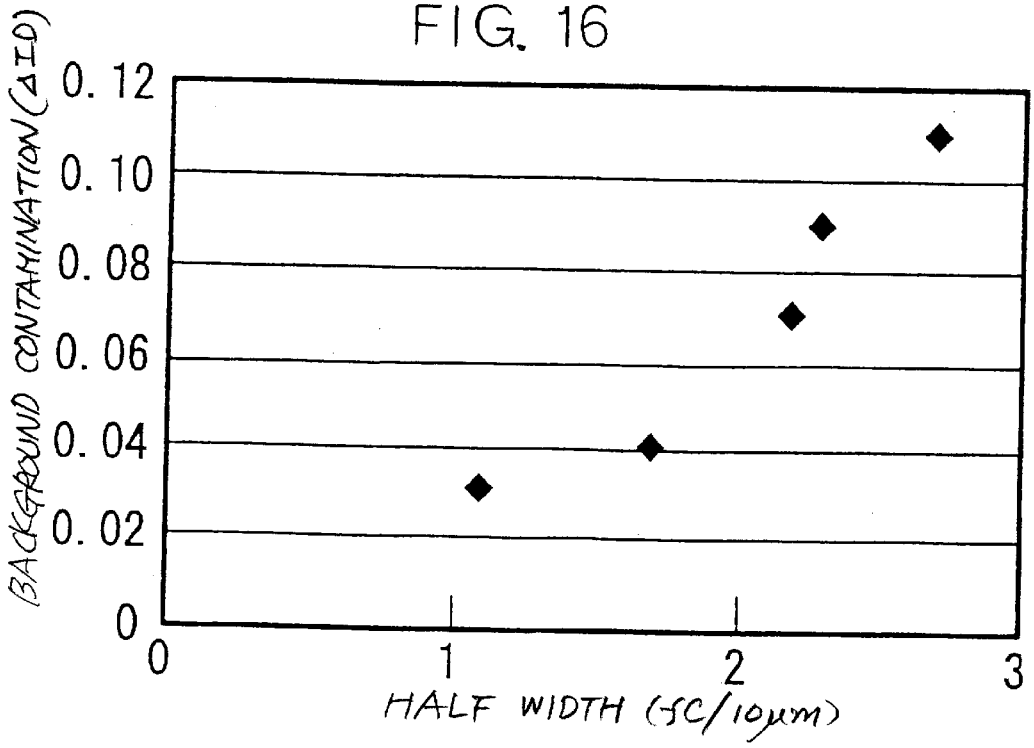
FIG. 16 is a graph showing a relation between the half width of the charge distribution profile of toner deposited on the developing roller and background contamination determined by experiments.

FIG. 16 shows experimental results representative of the half width of a relation between the charge distribution profile of toner on the developing roller 402 and the background contamination (ΔID). The index ΔID is defined by the equations (2) and (3) stated earlier. As FIG. 16 indicates, when the half width of the charge distribution profile exceeds 2.2 fC/10 $\mu$m, ΔID exceeds the allowable limit of 0.08 and aggravates background contamination. As for the experimental results shown in FIG. 13, the charge distribution profile of toner on the developing roller 402 had a half width of 1.1 fC/10 $\mu$m. By contrast, in the conventional developing device of the type described, the half width was as great as 2.7 fC/10 $\mu$m and caused background contamination to easily occur.

Figure 17:
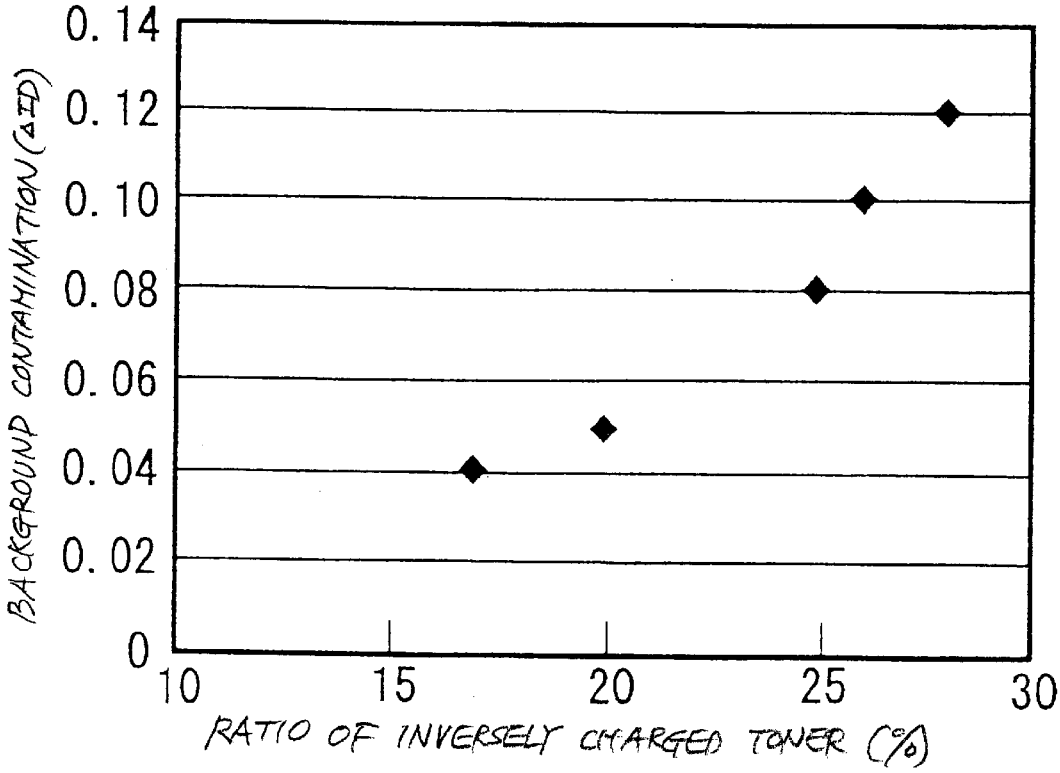
FIG. 17 is a graph showing a relation between the ratio of toner particles deposited on the developing roller and charged to polarity opposite to expected polarity and background contamination determined by experiments.

FIG. 17 shows experimental results representative of a relation between the ratio of toner particles of opposite polarity existing on the developing roller 402 and the background contamination (ΔID). As shown, when the ratio of toner particles of opposite polarity exceeds 25%, ΔID exceeds the allowable limit of 0.08 and aggravates background contamination. As for the experimental results shown in FIG. 13, the ratio of toner particles of opposite polarity deposited on the developing roller 402 was 19%. By contrast, in the conventional developing device of the type described, the above ratio was as great as 27% and caused background contamination to easily occur.

Figures 18, 19:
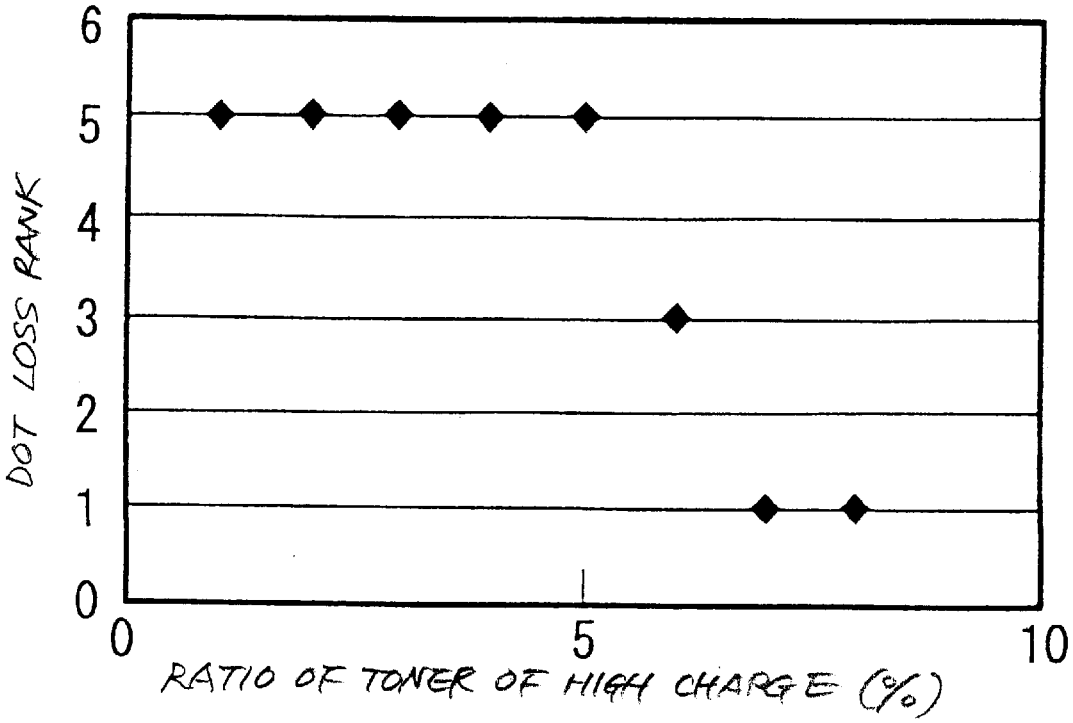
FIG. 18 is a graph showing a relation between the ratio of toner particles of high charge deposited on the developing roller and the loss of dots.
FIG. 19 is a table listing the property of a sample paper sheet used to measure the maximum static coefficient of friction of the photoconductive element.

FIG. 18 shows experimental results representative of a relation between the ratio of toner particles of high charge deposited on the developing roller 402 and the loss of dots. As for toner particles of high charge, toner particles charged by an amount four times or more greater in absolute value than the peak value of the charge distribution profile were counted. Dot loss ranks were determined by using a halftone image as a reference image and observing the degree of roughness of a toner image by eye. As shown, when the ratio of toner particles of high charge deposited on the developing roller 402 exceeds 5%, the dot loss rank is as low as "5" and renders a halftone image critically rough.

As stated above, in the illustrative embodiment, only the charged toner can be transferred from the magnet brush (two-ingredient type developer) deposited on the magnet brush roller 403 to the developing roller 402. It is therefore not necessary to charge the toner on the developing roller 402 by friction with a blade or similar contact member. This obviates toner filming on the developing roller 402 and the variation of developing characteristic ascribable to the wear of the developing roller and that of the contact member.

In the illustrative embodiment, the charge distribution of toner on the developing roller 402 and that of toner on the magnet brush roller 403 are different from each other. Therefore, toner having a desired charge distribution can deposit on the roller 402 even if the charge distribution of toner on roller 403 differs from desired one due to, e.g., the frictional charging characteristic required of the roller 403. This insures high-quality toner images free from background potential and short image density (loss of dots). In addition, the cleaning device 6 assigned to the drum 1 can be reduced in size.

The toner deposited on the developing roller 402 has a minimum of irregularity in the amount of charge and has a stable charge distribution. This insures stable saturation development particularly when the bilevel process is used. It follows that images free from roughness ascribable to background contamination and short density can be stably formed.

The illustrative embodiment has concentrated on an image transfer system that directly transfers a toner image from the drum 1 to a paper sheet. The present invention is, of course, practicable with an image transfer system that transfers a toner image from the drum 1 to an intermediate image transfer body and then to a paper sheet. For example, the present invention is applicable to a color image forming apparatus and a developing device therefor in which toner images of different colors are formed on a single photoconductive element one after another while being sequentially transferred to an intermediate image transfer body one above the other, and then the resulting composite color image is transferred from the transfer body to a paper sheet.

Further, the present invention is applicable to a tandem color image forming apparatus and a developing device therefor including an intermediate image transfer body implemented as an endless belt and a plurality of image forming units arranged along the belt. Toner images of different colors are respectively formed on photoconductive elements each being included in a particular image forming unit. The toner images are sequentially transferred to the belt one above the other, and then the resulting composite color image is transferred to a sheet.

Moreover, the present invention is applicable not only to a printer and a developing device therefor shown and described, but also to a copier, a facsimile apparatus and other image forming apparatuses and a developing device therefor.

In summary, it will be seen that the present invention provides an image forming apparatus and a developing device therefor having various unprecedented advantages, as enumerated below.

(1) It is not necessary to charge toner deposited on a toner carrier by friction with a blade or similar contact member. This obviates toner filming on the toner carrier and the variation of developing characteristic ascribable to the wear of the toner carrier and that of a contact member. Moreover, toner having a desired charge distribution can deposit on the toner carrier without regard to a frictional charging characteristic required of a toner supply member. Therefore, a high-quality toner image free from background contamination and short image density is achievable.

(2) Background contamination and short image density can be surely obviated, compared to a case wherein the charge distribution profile of toner deposited on a toner supply member has a half width greater than desired one and becomes the profile of toner on an toner carrier while maintaining such a half value. In addition, short image density ascribable to toner particles of high charge can be surely obviated.

(3) Even when the surface potential of an image carrier or the amount of charge or similar developing characteristic of a developer varies due to varying environment or aging, there can be obviated background contamination around pixels on which toner deposits and short image density of such pixels.

(4) Even when the distribution of the number of toner particles on the toner supply member for an amount of charge is relatively broad, the ratio of the toner particles on the toner supply member that are not charged by a desired amount is small. This insures a high-quality image in which the toner is scattered little.

(5) A cleaning device and an image forming process unit can be reduced in size.

Various modifications will become possible for those skilled in the art after receiving the teachings of the present disclosure without departing from the scope thereof.

What is claimed is:

1. A developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supply member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a half width of a profile of the number distribution is smaller on said toner carrier than on said toner supplying member.

2. The developing device as claimed in claim 1, wherein the number distribution has such a profile that a number of toner particles of low charge present at a lower amount of charge side in absolute value than an amount of charge, which maximizes a number of toner particles in a profile of the number distribution on said toner supply member, is reduced.

3. The developing device as claimed in claim 2, wherein the profile of the number distribution on said toner carrier has a half width of 2.2 fC/10 $\mu$m or below.

4. The developing device as claimed in claim 3, wherein a ratio of toner particles deposited on said toner carrier and charged to polarity opposite to preselected polarity is 25% or less.

5. The developing device as claimed in claim 1, wherein the number distribution has such a profile that a number of toner particles of high charge present at a higher amount of charge side in absolute value than an amount of charge, which maximizes a number of toner particles in a profile of the number distribution on said toner supply member, is reduced.

6. A developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supply member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein the number distribution has such a profile that a number of toner particles of low charge present at a lower amount of charge side in absolute value than an amount of charge, which maximizes a number of toner particles in a profile of the number distribution on said toner supply member, is reduced.

7. The developing device as claimed in claim 6, wherein a ratio of toner particles deposited on said toner carrier and charged to polarity opposite to preselected polarity is 25% or less.

8. The developing device as claimed in claim 6, wherein a ratio of toner particles of high charge deposited on said toner carrier and charged by an amount four times or more higher than the amount of charge that maximizes the number of particles is 5% or less.

9. The developing device as claimed in claim 6, wherein the profile of the number distribution on said toner carrier has a half width of 2.2 fC/10 $\mu$m or below.

10. The developing device as claimed in claim 9, wherein a ratio of toner particles deposited on said toner carrier and charged to polarity opposite to preselected polarity is 25% or less.

11. A developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supply member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein the number distribution has such a profile that a number of toner particles of high charge present at a higher amount of charge side in absolute value than an amount of charge, which maximizes a number of toner particles in a profile of the number distribution on said toner supply member, is reduced.

12. The developing device as claimed in claim 11, wherein a ratio of toner particles deposited on said toner carrier and charged to polarity opposite to preselected polarity is 25% or less.

13. The developing device as claimed in claim 11, wherein a ratio of toner particles of high charge deposited on said toner carrier and charged by an amount four times or more higher than the amount of charge that maximizes the number of particles.

14. The developing device as claimed in claim 11, wherein the profile of the number distribution on said toner carrier has a half width of 2.2 fC/10 μm or below.

15. The developing device as claimed in claim 14, wherein a ratio of toner particles deposited on said toner carrier and charged to polarity opposite to preselected polarity is 25% or less.

16. A developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supply member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a ratio of toner particles of high charge deposited on said toner carrier and charged by an amount four times or more higher than the amount of charge that maximizes the number of particles is 5% or less.

17. A developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supply member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a profile of the number distribution on said toner carrier has a half width of 2.2 fC/10 μm or below.

18. The developing device as claimed in claim 17, wherein a ratio of toner particles deposited on said toner carrier and charged to polarity opposite to preselected polarity is 25% or less.

19. A developing device for developing, among pixels forming a latent image formed on an image carrier, toner deposition pixels on which toner is expected to deposit such that tonality of said latent image is rendered in terms of a density of said toner deposition pixels for a unit area, said developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supplying member faces said toner carrier, whereby only said toner is fed from said toner supply member to said toner carrier in said toner supplying region, wherein developing conditions are selected such that, among the toner deposited on said toner carrier, all the toner facing the toner deposition pixels is transferred to the toner deposition pixels to effect saturation transfer when said toner deposition pixels pass the developing region, and wherein a ratio of toner particles deposited on said toner carrier and charged to a polarity opposite to a preselected polarity is 25% or less.

20. A developing device for developing, among pixels forming a latent image formed on an image carrier, toner deposition pixels on which toner is expected to deposit such that tonality of said latent image is rendered in terms of a density of said toner deposition pixels for a unit area, said developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supplying member faces said toner carrier, whereby only said toner is fed from said toner supply member to said toner carrier in said toner supplying region, wherein developing conditions are selected such that, among the toner deposited on said toner carrier, all the toner facing the toner deposition pixels is transferred to the toner deposition pixels to effect saturation transfer when said toner deposition pixels pass the developing region, and wherein a ratio of toner particles of high charge deposited on said toner carrier and charged by an amount four times or more higher than the amount of charge that maximizes the number of particles is 5% or less.

21. In an image forming apparatus comprising an image carrier, latent image forming unit for forming a latent image on said image carrier, a developing device for developing said latent image to thereby produce a corresponding toner image, and an image transferring device for transferring said toner image to a recording medium, said developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supplying member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a half width of a profile of the number distribution is smaller on said toner carrier than on said toner supplying member.

22. In an image forming apparatus comprising an image carrier, latent image forming unit for forming a latent image on said image carrier, a developing device for developing said latent image to thereby produce a corresponding toner image, an intermediate image transfer body to which said toner image is transferred from said image carrier, a primary image transferring device for transferring said toner image from said image carrier to said intermediate image transfer body, and a secondary image transferring device for transferring said toner image from said intermediate image transfer body to a recording medium, said developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supplying member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a half width of a profile of the number distribution is smaller on said toner carrier than on said toner supplying member.

23. In an image forming process unit comprising an image carrier, a charger for uniformly charging a surface of said image carrier, a developing device for developing said latent image to thereby produce a corresponding toner image, and a cleaning device for cleaning said surface of said image carrier that are constructed into a unit removable from an image forming apparatus, said developing device comprising:

a toner carrier for carrying toner on a surface thereof and for conveying said toner to a developing region where said toner carrier faces an image carrier; and a toner supply member for carrying thereon a two-ingredient type developer, which includes the toner and magnetic particles, and for conveying said developer to a toner supplying region where said toner supplying member faces said toner carrier, whereby only said toner is fed from said toner supply member to said toner carrier in said toner supplying region, wherein a number distribution, which is a distribution of a number of toner particles for an amount of charge deposited on said toner particles, differs from the toner particles conveyed to said developing region by said toner carrier to the toner particles contained in the developer that is deposited on said toner supply member, and wherein a half width of a profile of the number distribution is smaller on said toner carrier than on said toner supplying member.

* * * * *